US008766955B2

(12) United States Patent
Loveridge et al.

(10) Patent No.: US 8,766,955 B2
(45) Date of Patent: Jul. 1, 2014

(54) METHODS AND APPARATUS FOR LATENCY CONTROL IN DISPLAY DEVICES

(75) Inventors: Graham Loveridge, Mountain View, CA (US); Osamu Kobayashi, Los Altos, CA (US)

(73) Assignee: STMicroelectronics, Inc., Coppell, TX (US)

( * ) Notice: Subject to any disclaimer, the term of this patent is extended or adjusted under 35 U.S.C. 154(b) by 1447 days.

(21) Appl. No.: 11/828,212

(22) Filed: Jul. 25, 2007

(65) Prior Publication Data

US 2009/0027401 A1 Jan. 29, 2009

(51) Int. Cl.
*G09G 5/00* (2006.01)

(52) U.S. Cl.
USPC ..... 345/204

(58) Field of Classification Search
USPC ..... 345/204; 348/462, 515; 386/96; 725/110, 135
See application file for complete search history.

(56) References Cited

U.S. PATENT DOCUMENTS 7,068,686 B2 6/2006 Kobayashi
2005/0266924 A1* 12/2005 Horikoshi ..... 463/40
2006/0127053 A1* 6/2006 Lee ..... 386/96
2006/0143335 A1 6/2006 Ramamoorthy
2006/0156376 A1* 7/2006 Mukaide et al. ..... 725/135
2007/0123104 A1* 5/2007 Hisatomi ..... 439/607

OTHER PUBLICATIONS

VESA Enhanced Extended Display Identification Data—Implementation Guide, Version 1.0, Video Electronics Standards Association, Milpitas, CA (2001).
Stone, Donald L., Managing the Effect of Delay Jitter on the Display of Live Continuous Media, Ph.D. Dissertation, University of North Carolina at Chapel Hill, 1995.

* cited by examiner

*Primary Examiner* — Yong H Sim
(74) *Attorney, Agent, or Firm* — Beyer Law Group LLP

(57) ABSTRACT

Various methods, systems, and apparatus for implementing aspects of latency control in display devices are disclosed. According to aspects of the disclosed invention, a source device commands a display device to minimize the delay between the time that image data enters the display device and the time that it is shown on the display device. In one embodiment, the source device transmits data to the display device that specifies whether the display device should time optimize the image data, such as by transmitting a data packet for this purpose either with the image data or on an auxiliary communication link. In another embodiment, the source device and the display device are coupled via an interconnect that comprises multi-stream capabilities, and each stream is associated with a particular degree of latency optimization.

28 Claims, 6 Drawing Sheets

300

High-level diagram of link traffic example with three streams

METHODS AND APPARATUS FOR LATENCY CONTROL IN DISPLAY DEVICES

BACKGROUND OF THE INVENTION

1. Technical Field of the Invention

Implementations consistent with the principles of the invention generally relate to the field of display devices, more specifically to latency control in display devices.

2. Background of Related Art

Video display technology may be conceptually divided into analog-type display devices (such as cathode ray tubes ("CRTs")) and digital-type display devices (such as liquid crystal displays ("LCDs"), plasma display panels, and the like), each of which must be driven by appropriate input signals to successfully display an image. For example, a typical analog system may include an analog source (such as a personal computer ("PC"), digital video disk ("DVD") player, and the like) coupled to a display device (sometimes referred to as a video sink) by way of a communication link. The communication link typically takes the form of a cable (such as an analog video graphics array ("VGA") cable in the case of a PC) well known to those of skill in the art.

More recently, digital display interfaces have been introduced, which typically use digital-capable cables. For example, the Digital Visual Interface ("DVI") is a digital interface standard created by the Digital Display Working Group ("DDWG"), and is designed for carrying digital video data to a display device. According to this interface standard, data are transmitted using the transition-minimized differential signaling ("TMDS") protocol, providing a digital signal from a PC's graphics subsystem to the display device, for example. As another example, DisplayPort™ is a digital video interface standard from the Video Electronics Standards Association ("VESA"). DisplayPort™ may serve as an interface for CRT monitors, flat panel displays, televisions, projection screens, home entertainment receivers, and video port interfaces in general. In one embodiment, DisplayPort™ provides four lanes of data traffic for a total bandwidth of up to 10.8 gigabits per second, and a separate bi-directional channel handles device control instructions. DisplayPort™ embodiments incorporate a main link, which is a high-bandwidth, low-latency, unidirectional connection supporting isochronous stream transport. Each DisplayPort™ main link may comprise one, two, or four double-terminated differential-signal pairs with no dedicated clock signal; instead, the data stream is encoded using 8B/10B signaling, with embedded clock signals. AC coupling enables DisplayPort™ transmitters and receivers to operate on different common-mode voltages. In addition to digital video, DisplayPort™ interfaces may also transmit audio data, eliminating the need for separate audio cables.

As display devices strive to improve image quality by providing various stages of image processing, they may introduce longer and longer delays between the time that image data enters the display device and the time that it is finally displayed. Such a delay, sometimes called "display latency," may create unacceptable time differences in the system (e.g., between the source device and the display device), and may also degrade its usability from a user control point of view. For example, if the source device is a game console, a long delay between the time that an image enters the display device and the time that it is actually displayed may render the game unplayable. For instance, consider a game scenario in which a character must jump over an obstacle. As the scenario progresses, the user naturally perceives and determines the proper time to jump based upon the physically displayed image. If the time lag between the time that the image enters the display device and the time that it is shown is too long, the game character may have already crashed into the object before the user activates the "jump" button.

As another example, this problem may also be experienced in situations where a user transmits commands to a source device, such as by activating buttons on a remote control device or directly on the source device console. If the delay from the time that image data enters the display device to the time that it is actually displayed is too long, the user may become frustrated by the time lag experienced between the time that a command was issued (e.g., the time that the user pressed a button on the source device or its remote control) to the time that execution of the command is perceived or other visual feedback is provided by the system (e.g., the time that the user sees a response on the display device).

It is desirable to address the limitations in the art.

BRIEF SUMMARY OF THE INVENTION

Various methods, systems, and apparatus for implementing aspects of latency control in display devices are disclosed. According to aspects of the disclosed invention, a source device commands a display device to minimize the delay between the time that image data enters the display device and the time that it is shown on the display device, thereby eliminating the need for a user to manually set up the delay of each source device, and enabling the source device to control the presentation of the image. In one embodiment, the source device transmits data to the display device that specifies whether the display device should time optimize the image data, such as by transmitting a data packet for this purpose either with the image data or on an auxiliary communication link. The data sent by the source device may be either initiated by the source device or in response to a query from the display device. In another embodiment, the source device and the display device are coupled via an interconnect that comprises multi-stream capabilities, and each stream is associated with a particular degree of latency optimization. In yet another embodiment, a multi-link interconnect may be used, yet information is transmitted from the source device to the display device to dynamically set up each data stream and enable the source device to control whether an individual stream is time optimized.

Other aspects and advantages of the present invention can be seen upon review of the figures, the detailed description, and the claims that follow.

BRIEF DESCRIPTION OF THE DRAWINGS

The accompanying drawings are for the purpose of illustrating and expounding the features involved in the present invention for a more complete understanding, and not meant to be considered as a limitation, wherein.

DETAILED DESCRIPTION

Figure 1:
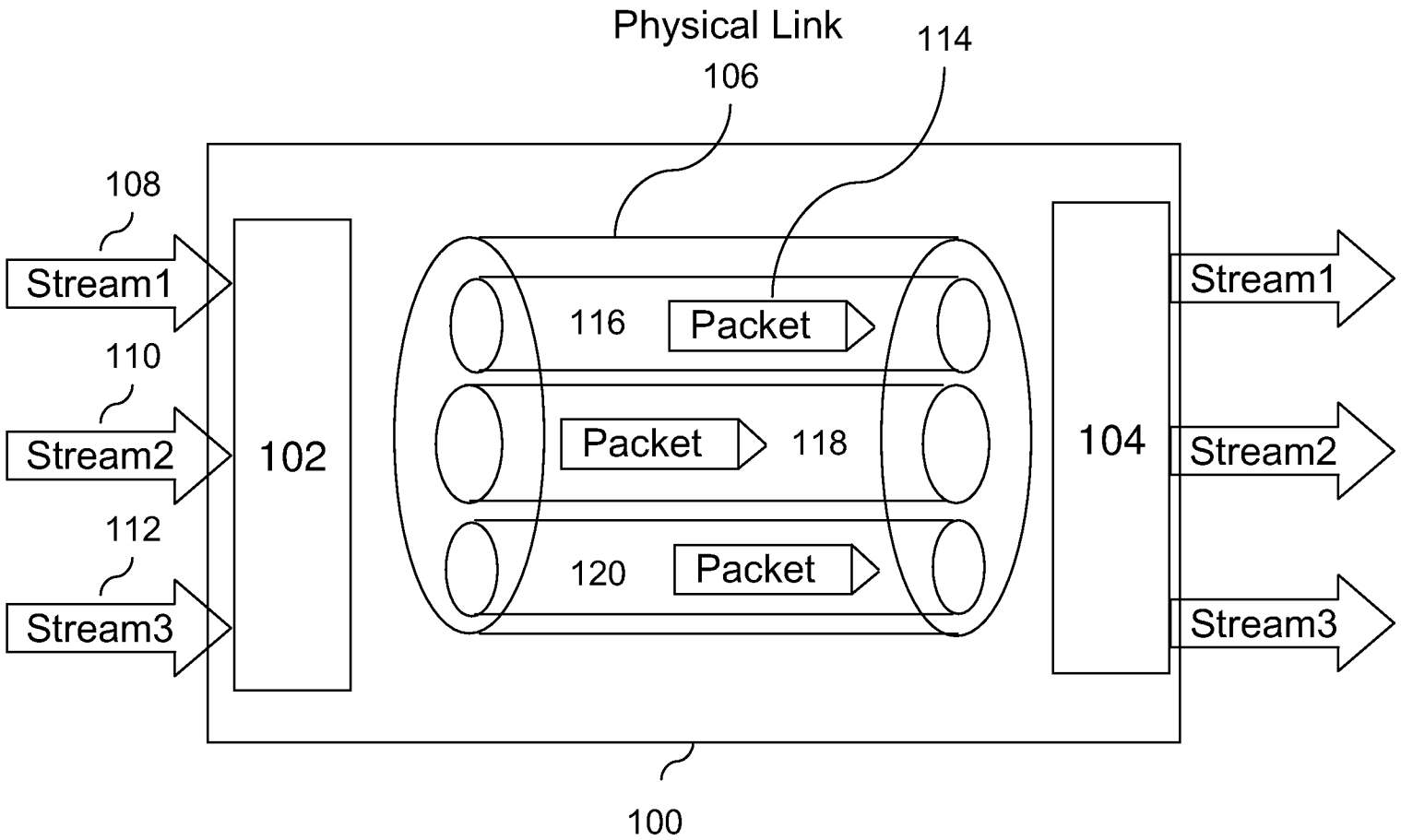
FIG. 1 shows a generalized representation of an exemplary cross-platform display interface.

Those of ordinary skill in the art will realize that the following description of the present invention is illustrative only and not in any way limiting. Other embodiments of the invention will readily suggest themselves to such skilled persons, having the benefit of this disclosure. Reference will now be made in detail to an implementation of the present invention as illustrated in the accompanying drawings. The same reference numbers will be used throughout the drawings and the following description to refer to the same or like parts.

Unless specifically stated otherwise as apparent from the following discussions, it is appreciated that throughout the present invention, discussions utilizing terms such as "receiving," "determining," "composing," "storing," or the like, refer to the actions and processes of a computer system, or similar electronic computing device. The computer system or similar electronic device manipulates and transforms data represented as physical electronic quantities within the computer system's registers and memories into other data similarly represented as physical quantities within the computer system memories or registers or other such information storage, transmission, or display devices.

Further, certain figures in this specification are flow charts illustrating methods and systems. It will be understood that each block of these flow charts, and combinations of blocks in these flow charts, may be implemented by computer program instructions. These computer program instructions may be loaded onto a computer or other programmable apparatus to produce a machine, such that the instructions which execute on the computer or other programmable apparatus create structures for implementing the functions specified in the flow chart block or blocks. These computer program instructions may also be stored in a computer-readable memory that can direct a computer or other programmable apparatus to function in a particular manner, such that the instructions stored in the computer-readable memory produce an article of manufacture including instruction structures which implement the function specified in the flow chart block or blocks. The computer program instructions may also be loaded onto a computer or other programmable apparatus to cause a series of operational steps to be performed on the computer or other programmable apparatus to produce a computer implemented process such that the instructions which execute on the computer or other programmable apparatus provide steps for implementing the functions specified in the flow chart block or blocks.

Accordingly, blocks of the flow charts support combinations of structures for performing the specified functions and combinations of steps for performing the specified functions. It will also be understood that each block of the flow charts, and combinations of blocks in the flow charts, can be implemented by general- or special-purpose hardware-based computer systems which perform the specified functions or steps, or combinations of general- or special-purpose hardware and computer instructions.

For example, FIG. 1 shows a generalized representation of an exemplary cross-platform packet-based digital video display interface (100). The interface (100) connects a transmitter (102) to a receiver (104) by way of a physical link (106) (which may also be referred to as a pipe). As shown in FIG. 1, a number of data streams (108, 110, 112) are received at the transmitter (102) that, if necessary, packetizes each into a corresponding number of data packets (114). These data packets are then formed into corresponding data streams, each of which are passed by way of an associated virtual pipe (116, 118, 120) to the receiver (104). The link rate (i.e., the data packet transfer rate) for each virtual link may be optimized for the particular data stream, resulting in the physical link (106) carrying data streams each having an associated link rate (each of which could be different from each other depending upon the particular data stream). The data streams (108, 110, 112) may take any number of forms, such as video, graphics, audio, and the like.

Typically, in the case of a video source, the data streams (108, 110, 112) may include various video signals that may comprise any number and type of well-known formats, such as composite video, serial digital, parallel digital, RGB, or consumer digital video. The video signals may be analog signals, such as, for example, signals generated by analog television ("TV") sets, still cameras, analog video cassette recorders ("VCR"), DVD players, camcorders, laser disk players, TV tuners, set-top boxes (with digital satellite service ("DSS") or cable signals) and the like. The video signals may also be generated by digital sources such as, for example, digital television sets ("DTV"), digital still cameras, digital-enabled game consoles, and the like. Such digital video signals may comprise any number and type of well-known digital formats such as, for example, SMPTE 274M-1995 (1920×1080 resolution, progressive or interlaced scan), SMPTE 296M-1997 (1280×720 resolution, progressive scan), as well as standard 480-line progressive scan video.

As is well known, in the case where the source provides an analog video image signal, an analog-to-digital ("A/D") converter may translate an analog voltage or current signal into a discrete series of digitally encoded numbers, forming in the process an appropriate digital image data word suitable for digital processing. Any of a wide variety of commercially available A/D converters may be used. For example, referring to FIG. 1, if data stream (108) is an analog-type video signal, the A/D converter (not shown) included in or coupled to the transmitter (102) may digitize the analog data stream, which is then packetized into a number of data packets (114), each of which may be transmitted to the receiver (104) by way of virtual link (116). The receiver (104) may then reconstitute the data stream (110) by appropriately recombining the data packets (114) into their original format. The link rate may be independent of the native stream rates, and the link bandwidth of the physical link (106) should be higher than the aggregate bandwidth of data stream(s) to be transmitted. The incoming data (such as pixel data in the case of video data) may be packed over the respective virtual link based upon a data mapping definition. In this way, the physical link (106) (or any of the constituent virtual links) does not carry one pixel data per link character clock. In this way, the exemplary interface (100) provides a scalable medium for the transport of not only video and graphics data, but also audio and other application data as may be required in a particular implementation. In addition, hot-plug event detection may be provided, and a physical link (or pipe) may be automatically configured to its optimum transmission rate.

In addition to providing video and graphics data, display timing information may be embedded in the digital data stream, thereby enabling display alignment and eliminating the need for features such as "auto-adjust" and the like. The packet-based nature of the interface shown in FIG. 1 provides scalability to support multiple, digital data streams, such as multiple video/graphics streams and audio streams for multimedia applications. In addition, a universal serial bus ("USB") transport for peripheral attachment and display control may be provided without the need for additional cabling.

Figure 2:
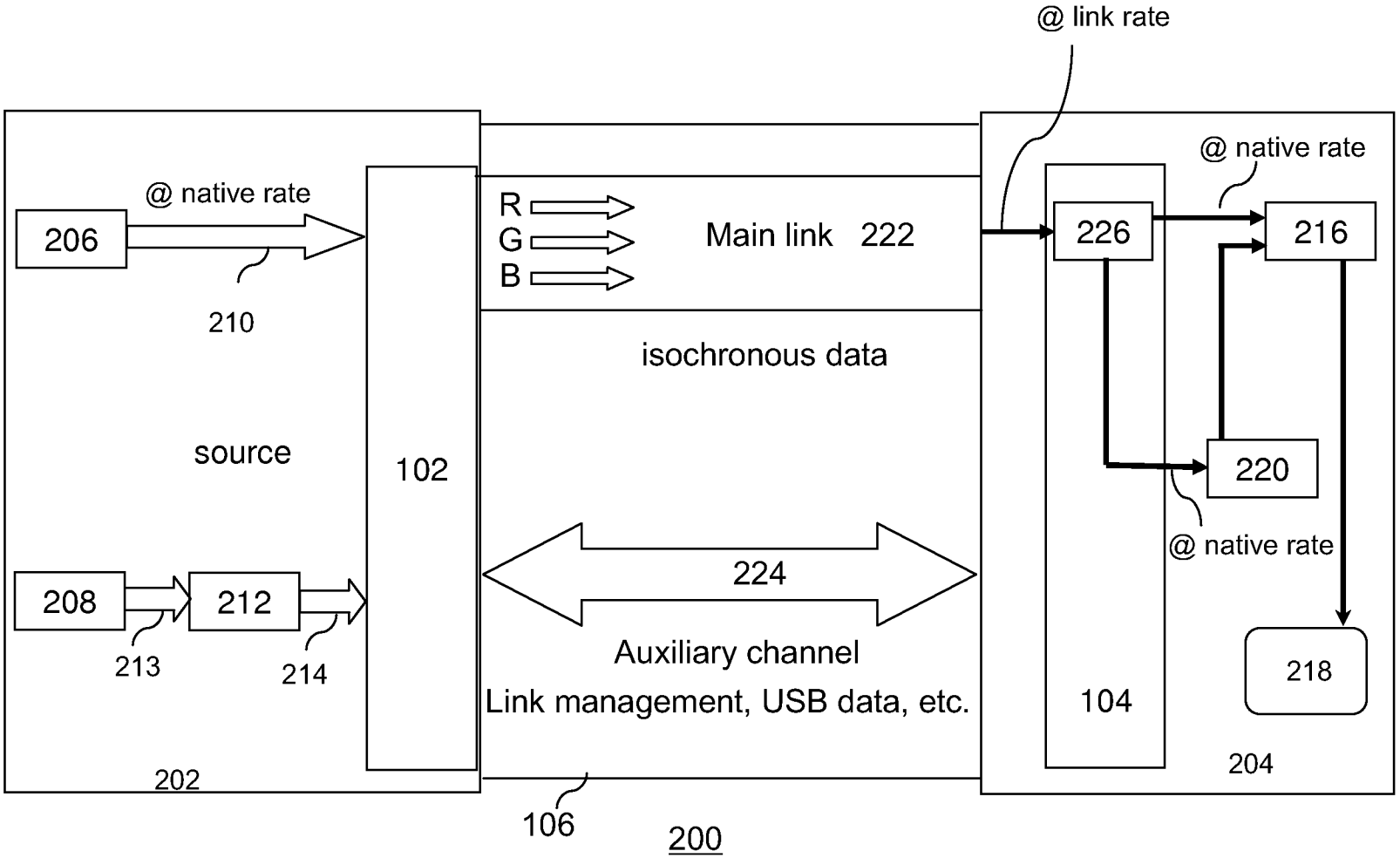
FIG. 2 illustrates an exemplary video interface system that is used to connect a video source and a video display unit.

FIG. 2 illustrates a system (200) based upon the generalized system (100) of FIG. 1, that is used to connect a video source (202) and a video display device (204). As shown in FIG. 2, the video source (202) may include either or both a digital image (or digital video source) (206) and an analog image (or analog video source) (208). In the case of the digital image source (206), a digital data stream (210) is provided to the transmitter (102), whereas in the case of the analog video source (208), an A/D converter unit (212) coupled thereto, converts an analog data stream (213) to a corresponding digital data stream (214). The digital data stream (214) is then processed in much the same manner as the digital data stream (210) by the transmitter (102). The display device (204) may be an analog-type display or a digital-type display, or in some cases may process either analog or digital signals. In any case, the display device (204) as shown in FIG. 2 includes a display interface (216) that couples the receiver (104) with a display (218) and a digital-to-analog ("D/A") converter unit (220) in the case of an analog-type display. As shown in FIG. 2, the video source (202) may take any number of forms, as described earlier, whereas the video display unit (104) may take the form of any suitable video display (such as an LCD-type display, CRT-type display, plasma display panel, or the like).

Regardless of the type of video source or video sink, however, as shown in FIG. 2, the various data streams may be digitized (if necessary) and packetized prior to transmission over the physical link 106, which includes a uni-directional main link (222) for isochronous data streams and a bi-directional auxiliary channel (224) for link setup and other data traffic (such as various link management information, USB data, and the like) between the video source (202) and the video display (204). The main link (222) may thereby be capable of simultaneously transmitting multiple isochronous data streams (such as multiple video/graphics streams and multi-channel audio streams). As shown in FIG. 2, the main link (222) includes a number of different virtual channels, each capable of transferring isochronous data streams (such as uncompressed graphics/video and audio data) at multiple gigabits per second ("Gbps"). From a logical viewpoint, therefore, the main link (222) may appear as a single physical pipe, and within this single physical pipe multiple virtual pipes may be established. In this way, logical data streams need not be assigned to physical channels. Rather, each logical data stream may be carried in its own logical pipe (e.g., the virtual channels described earlier).

The speed, or transfer rate, of the main link (222) may be adjustable to compensate for link conditions. For example, in one implementation, the speed of the main link (222) may be adjusted in a range approximated by a slowest speed of about 1.0 Gbps to about 2.5 Gbps per channel, in approximately 0.4 Gbps increments. A main link data rate may be chosen whose bandwidth exceeds the aggregate bandwidth of the constituent virtual links. Data sent to the interface arrives at the transmitter at its native rate, and a time-base recovery ("TBR") unit 226 (shown in FIG. 2) within the receiver (104) may regenerate the stream's original native rate using time stamps embedded in the main link data packets, if necessary.

Figure 3:
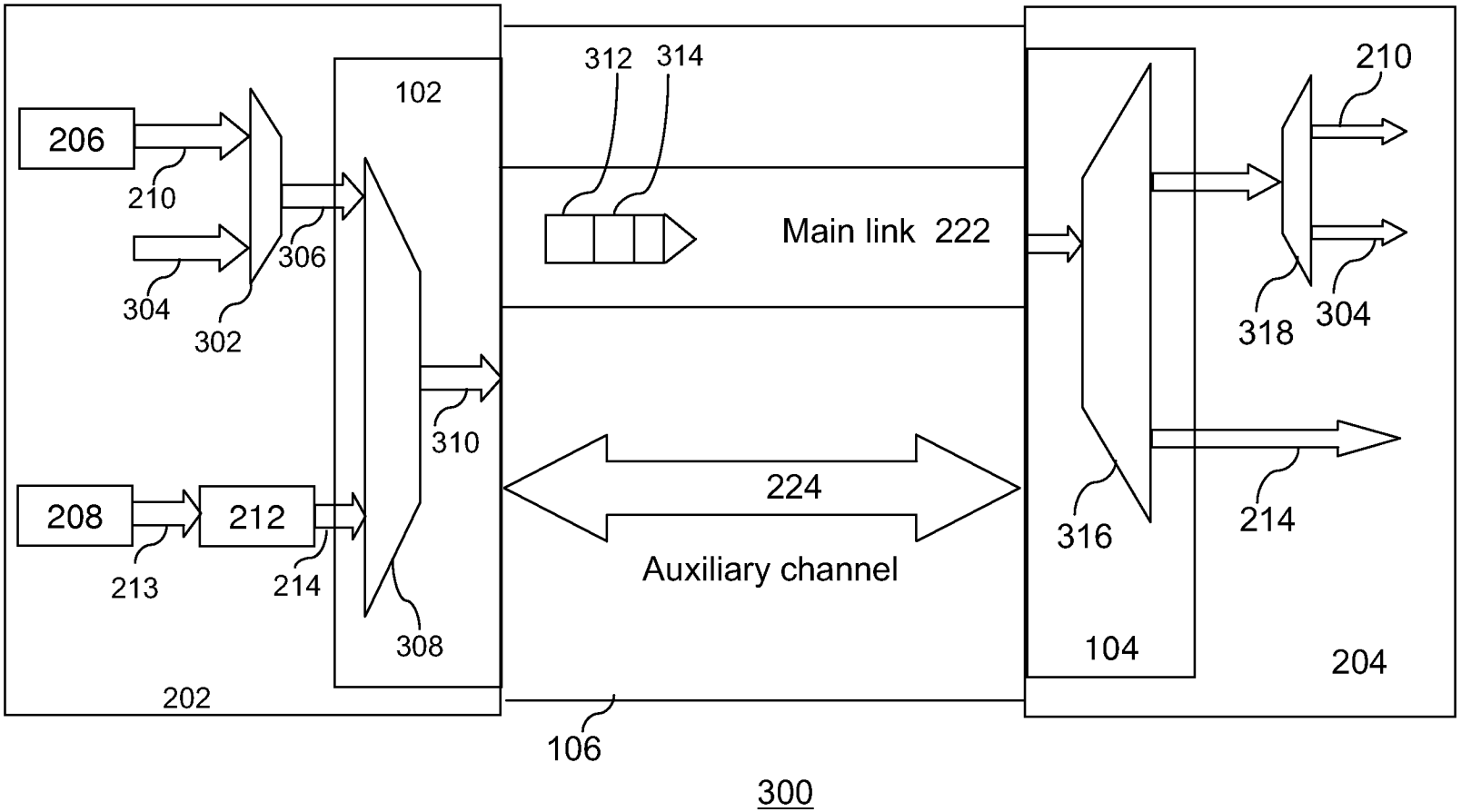
FIG. 3 illustrates a system arranged to provide sub-packet enclosure and multiple-packet multiplexing.

Such an interface is able to multiplex different data streams, each of which may comprise different formats, and may include main link data packets that comprise a number of sub packets. For example, FIG. 3 shows a system (300) arranged to provide sub-packet enclosure and multiple-packet multiplexing. System (300) is a particular embodiment of system (200) shown in FIG. 2, and comprises a stream source multiplexer (302) included in transmitter (102), used to combine a supplemental data stream (304) with data stream (210) to form a multiplexed data stream (306). The multiplexed data stream (306) is then forwarded to a link layer multiplexer 308 that combines any of a number of data streams to form a multiplexed main link stream (310) formed of a number of data packets (312), some of which may include any of a number of sub packets (314) enclosed therein. A link layer de-multiplexer (316) splits the multiplexed data stream (310) into its constituent data streams based on the stream identifiers ("SIDs") and associated sub packet headers, while a stream sink de-multiplexer (318) further splits off the supplemental data stream contained in the sub-packets.

Figure 4:
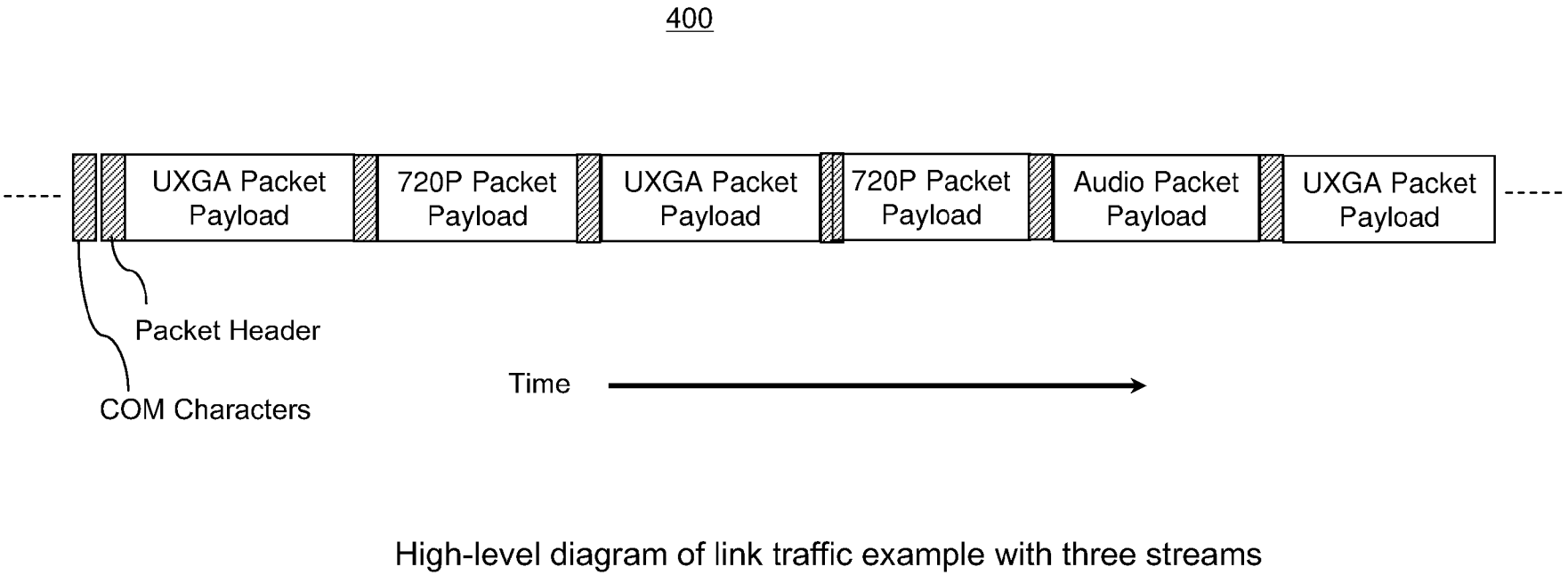
FIG. 4 depicts a high-level diagram of a multiplexed main link stream, when three streams are multiplexed over the main link.

FIG. 4 shows a high-level diagram of a multiplexed main link stream (400) as an example of the stream (310) shown in FIG. 3 when three streams are multiplexed over the main link (222). The three streams in this example are: UXGA graphics (Stream ID=1), 1280×720 p video (Stream ID=2), and audio (Stream ID=3). In one embodiment, small packet header size of main link packet (400) minimizes the packet overhead, and this increases link efficiency. Packet headers may be relatively small in certain embodiments because the packet attributes may be communicated via the auxiliary channel (224) (as shown in FIGS. 2 and 3) prior to the transmission of the packets over main link (222).

In general, the sub-packet enclosure is an effective scheme when the main packet stream is an uncompressed video, since an uncompressed video data stream has data idle periods corresponding to the video-blanking period. Therefore, main link traffic formed of an uncompressed video stream will include a series of null special character packets during this video-blanking period. By capitalizing on the ability to multiplex various data streams, certain implementations of the present invention use various methods to compensate for differences between the main link rate and the pixel data rate when the source stream is a video data stream.

In certain embodiments, the auxiliary channel (224) may also be used to transmit main link packet stream descriptions, thereby reducing the overhead of packet transmissions on the main link (222). Furthermore, the auxiliary channel (224) may be configured to carry Extended Display Identification Data ("EDID") information, replacing the Display Data Channel ("DDC") found on monitors. As is well known, EDID is a VESA standard data format that contains basic information about a monitor and its capabilities, including vendor information, maximum image size, color characteristics, factory pre-set timings, frequency range limits, and character strings for the monitor name and serial number. The information is stored in the display and is used to communicate with the system through the DDC, which resides between the monitor and the PC graphics adapter. The system uses this information for configuration purposes, so the monitor and system may work together. In what is referred to as an extended protocol mode, the auxiliary channel may carry both asynchronous and isochronous packets as required to support additional data types such as keyboard, mouse and microphone.

Figure 5:
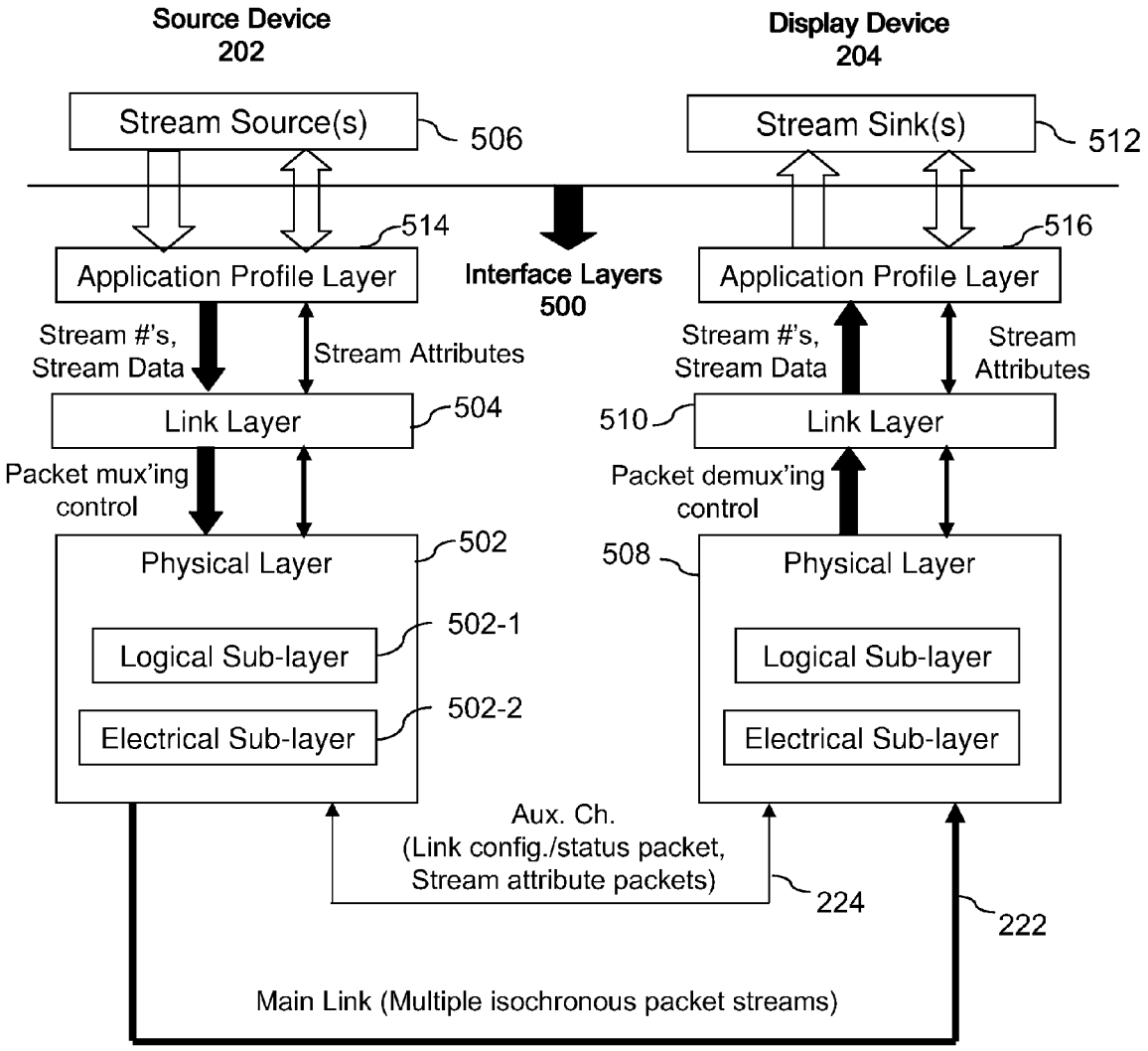
FIG. 5 illustrates a logical layering of the system in accordance with aspects of the invention.

FIG. 5 illustrates a logical layering (500) of the system (200) in accordance with an embodiment of the invention. While the implementation may vary depending upon application, generally, a source (such as video source 202) is formed of a source physical layer (502) that includes transmitter hardware, a source link layer (504) that includes multiplexing hardware and state machines (or firmware), and a data stream source (506) such as audio/visual/graphics hardware and associated software. Similarly, a display device typically comprises a physical layer (508) (including various receiver hardware), a sink link layer (510) that includes de-multiplexing hardware and state machines (or firmware), and a stream sink (512) that includes display/timing controller hardware and optional firmware. A source application profile layer (514) defines the format with which the source communicates with the link layer (504), and, similarly, a sink application profile layer (516) defines the format with which the sink (512) communicates with the sink link layer (510).

As shown in FIG. 5, the source device physical layer (502) includes an electrical sub layer (502-1) and a logical sub layer (502-2). The electrical sub layer (502-1) includes all circuitry for interface initialization/operation, such as hot plug/unplug detection circuits, drivers/receivers/termination resistors, parallel-to-serial/serial-to-parallel converters, and spread-spectrum-capable phase-locked loops ("PLLs"). The logical sub layer (502-2) includes circuitry for packetizing/de-packetizing, data scrambling/de-scrambling, pattern generation for link training, time-base recovery circuits, and data encoding/decoding such as 8B/10B signaling (as specified in ANSI X3.230-1994, clause 11) that provides 256 link data characters and twelve control characters for the main link (222) and Manchester II encoding for the auxiliary channel (224). To avoid the repetitive bit patterns exhibited by uncompressed display data (and hence, to reduce electromagnetic interference ("EMI")), data transmitted over main link (222) may first be scrambled before 8B/10B encoding.

Since data stream attributes may be transmitted over the auxiliary channel (224), the main link packet headers may serve as stream identification numbers, thereby reducing overhead and maximizing link bandwidth. In certain embodiments, neither the main link (222) nor the auxiliary link (224) has separate clock signal lines. In this way, the receivers on main link (222) and auxiliary link (224) may sample the data and extract the clock from the incoming data stream. Fast phase locking for PLL circuits in the receiver electrical sub layer is important in certain embodiments, since the auxiliary channel 224 is half-duplex bi-directional and the direction of the traffic changes frequently. Accordingly, the PLL on the auxiliary channel receiver may phase lock in as few as 16 data periods, facilitated by the frequent and uniform signal transitions of Manchester II (MII) code.

At link set-up time, the data rate of the main link (222) may be negotiated via handshaking over auxiliary channel (224). During this process, known sets of training packets may be set over the main link (222) at the highest link speed. Success or failure may be communicated back to the transmitter (102) via the auxiliary channel (224). If the training fails, the main link speed may be reduced, and training may be repeated until successful. In this way, the source physical layer (502) is made more resistant to cable problems and therefore more suitable for external host-to-monitor applications. However, the main channel link data rate may be decoupled from the pixel clock rate, and a link data rate may be set so that the link bandwidth exceeds the aggregate bandwidth of the transmitted streams.

The source link layer (504) may handle link initialization and management. For example, upon receiving a hot-plug detect event generated upon monitor power-up or connection of the monitor cable from the source physical layer (502), the source device link layer (504) may evaluate the capabilities of the receiver via interchange over the auxiliary channel (224) to determine a maximum main link data rate as determined by a training session, the number of time-base recovery units on the receiver, available buffer size on both ends, or availability of USB extensions, and then notify the stream source (506) of an associated hot-plug event. In addition, upon request from the stream source (506), the source link layer (504) may read the display capability (EDID or equivalent). During a normal operation, the source link layer (504) may send the stream attributes to the receiver (104) via the auxiliary channel (224), notify the stream source (504) whether the main link (222) has enough resources for handling the requested data streams, notify the stream source (504) of link failure events such as synchronization loss and buffer overflow, and send Monitor Control Command Set ("MCCS") commands submitted by the stream source (504) to the receiver via the auxiliary channel (224). Communications between the source link layer (504) and the stream source/sink may use the formats defined in the application profile layer (514).

In general, the application profile layer (514) may define formats with which a stream source (or sink) will interface with the associated link layer. The formats defined by the application profile layer (514) may be divided into the following categories: application independent formats (e.g., link message for link status inquiry), and application dependent formats (e.g., main link data mapping, time-base recovery equation for the receiver, and sink capability/stream attribute messages sub-packet formats, if applicable). The application profile layer may support the following color formats: 24-bit RGB, 16-bit RG2565, 18-bit RGB, 30-bit RGB, 256-color RGB (CLUT based), 16-bit, CbCr422, 20-bit YCbCr422, and 24-bit YCbCr444. For example, the display device application profile layer ("APL") (514) may be essentially an application-programming interface ("API") describing the format for stream source/sink communication over the main link (222) that includes a presentation format for data sent to or received from the interface (100). Since some aspects of the APL (514) (such as the power management command format) are baseline monitor functions that are common to all uses of the interface 100. Other non-baseline monitor functions, such as such as data mapping formats and stream attribute formats, may be unique to an application or a type of isochronous stream that is to be transmitted. Regardless of the application, the stream source (504) may query the source link layer (514) to ascertain whether the main link (222) is capable of handling the pending data stream(s) prior to the start any packet stream transmission on the main link (222).

When it is determined that the main link (222) is capable of supporting the pending packet stream(s), the stream source (506) may send stream attributes to the source link layer (514) that is then transmitted to the receiver over the auxiliary channel (224) or enclosed in a secondary data packet that is transmitted over the main link. These attributes are the information used by the receiver to identify the packets of a particular stream, to recover the original data from the stream and to format it back to the stream's native data rate. The attributes of the data stream may be application dependent. In cases where the desired bandwidth is not available on the main link (222), the stream source (514) may take corrective action by, for example, reducing the image refresh rate or color depth.

The display device physical layer (508) may isolate the display device link layer (510) and the display device APL (516) from the signaling technology used for link data transmission/reception. The main link (222) and the auxiliary channel (224) have their own physical layers, each consisting of a logical sub layer and an electrical sub layer that includes the connector specification. For example, the half-duplex, bi-directional auxiliary channel (224) may have both a transmitter and a receiver at each end of the link.

The functions of the auxiliary channel logical sub layer may include data encoding and decoding, and framing/de-framing of data. In certain embodiments, there are two auxiliary channel protocol options. First, the standalone protocol (limited to link setup/management functions in a point-to-point topology) is a lightweight protocol that can be managed by the link layer state-machine or firmware. Second, the extended protocol may support other data types such as USB traffic and topologies such as daisy-chained sink devices. The data encoding and decoding scheme may be identical regardless of the protocol, whereas framing of data may differ between the two.

According to aspects of the present invention, a source device (e.g., DVD player, game console, and the like) instructs a display device to minimize the delay between the time that image data enters the display device and the time that it is shown on the display device. These aspects of the present invention may eliminate the need for a user to manually set up the delay for each source device, and allows the source device to control the presentation of the image. Thus, according to aspects of the invention, the source device may control whether the image data it is sending should be time optimized by the display device. In this context, "time optimized," refers to a process where the amount of time required to display an input image data stream measured from the time that it enters the display device is minimized by altering the data processing path within the display device. Such time optimization may be implemented in various ways.

Figure 6:
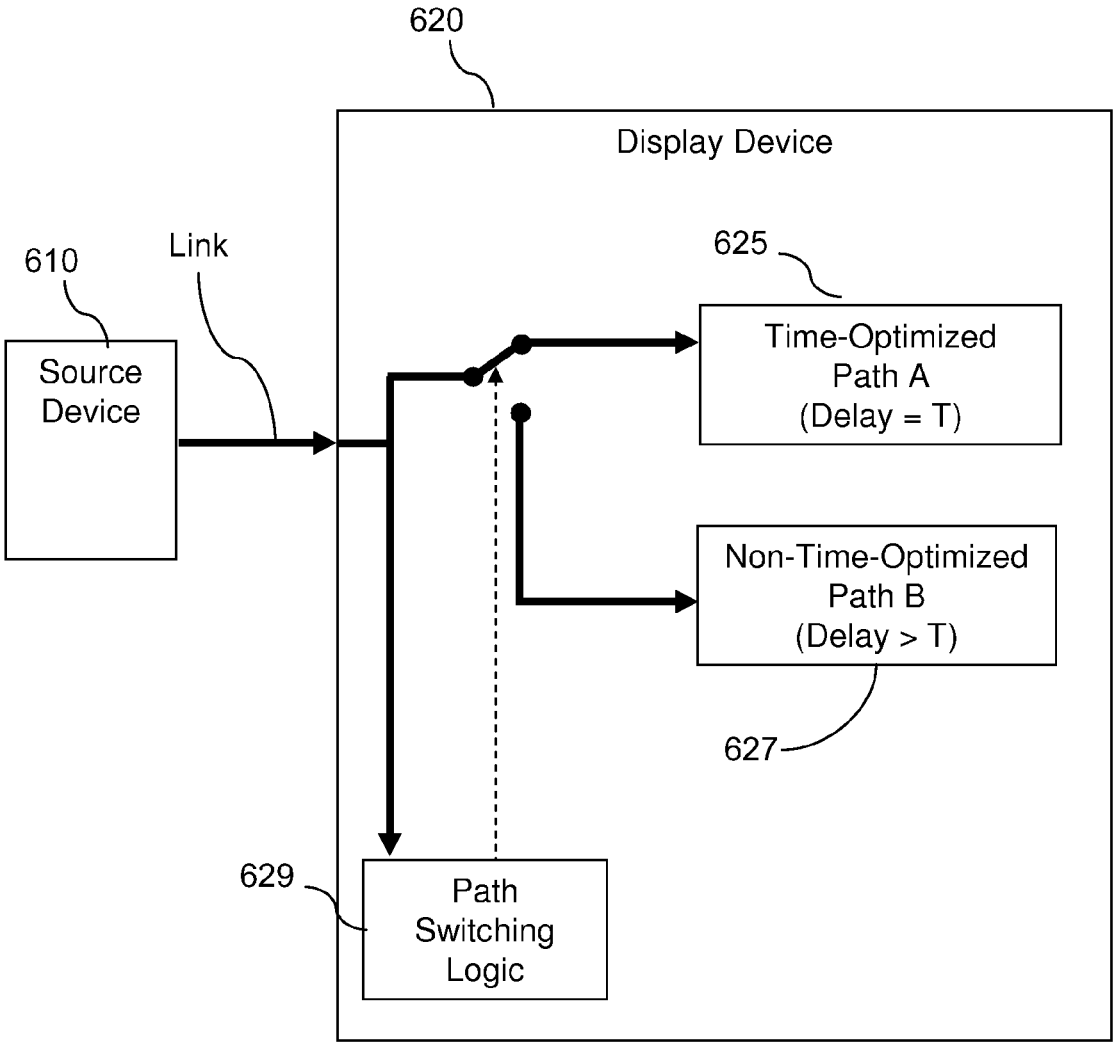
FIG. 6 depicts an exemplary system for latency control in display devices according to aspects of the present invention.

For example, in one embodiment the source device transmits data to the display device that specifies whether the display device should time optimize the image data. This can be achieved, for example, by transmitting a small data packet either along with the image data or on an auxiliary communication link. The time optimization data sent by the source device may be either initiated by the source device or in response to a query from the display device. As shown in FIG. 6, for example, a source device (610) may transmit image data along with time optimization data across an interconnect channel (e.g., HMDI, DisplayPort™, composite video, and the like) to a display device (620). As shown in the exemplary system depicted in FIG. 6, display device (620) comprises two processing paths: a time-optimized processing path (625, characterized by Delay=T), and a non-time-optimized processing path (627, characterized by Delay>T). Typically, the non-time-optimized processing path (627) may involve additional image processing stages beyond those provided along time-optimized processing path (625). Display device (620) also comprises switching logic (629) that extracts the time optimization commands/data from the incoming data streams and directs the incoming image data stream(s) to either the time-optimized processing path (625) or the non-optimized processing path (627) as appropriate.

As another example, the source device and the display device may be coupled using a single interconnect (e.g., HMDI, DisplayPort™, and the like) that has multi-stream capabilities as described earlier, and where each stream is associated with a specified degree of time optimization. A multi-stream interconnect may use time-division multiplexing or multiple individual links to transmit data. Within this embodiment, image data enters the link as separate data streams, as described earlier. Then, for example, assume there are two data streams: data stream A and data stream B. Due to a convention known by both the source device and the display device, it is known that stream A will be time optimized by the display device but stream B will not. This predetermined exemplary convention allows the source device to decide whether to transmit image data on stream A or stream B, depending on the desired degree of latency control. As yet another example, a multi-link interconnect may be used and information may be transmitted from the source device to the display device to dynamically set up each data stream and to allow the source device to control whether an individual stream is time optimized.

In yet other embodiments, to enable the source device to control the presentation of the material on the display device, two-way communication may be established between the display device and the source device. For example, the display device may transmit packets to the source device (e.g., on an auxiliary channel) to inform the source device of the processing services/stages that are available on the display device, and the source may then respond by informing the display device which processing services/stages may be performed and which should be bypassed to achieve a certain degree of time optimization. Processing services/stages available on the display device may include, but need not be limited, to the following: scaling (e.g., image resolution may be adjusted to the display resolution), aspect ratio conversion (e.g., the image aspect ratio can be adjusted to fit the display format), de-interlacing, film mode (e.g., the image can be processed and de-interlaced using inverse 3:2 pull down), frame rate conversion (e.g., the image can be frame rate converted to a new refresh rate), motion compensation (e.g., the image can processed to remove jitter or create new intermediate frames), color controls, gamma correction, dynamic contrast enhancement, sharpness control, and/or noise reduction.

In accordance with other aspects of the invention, the apparent time lag of display devices that utilize algorithms that may insert a noticeable delay when a source device pauses the playback may be reduced. As the processing gets more and more sophisticated in the display devices, the time lag from when the image enters the display to the time that it appears on the physical display device may increase to a point where the lag is noticeable by the user. This latency may cause an annoying user interface issue when performing control functions on the source device such as pausing playback. In such a situation, the user may press the "pause" on the source device or its remote control, but the image on the display device may seems to take a noticeable while to pause, thereby making it impossible for the user to pick the exact moment to freeze the image. To solve this time lag problem, the display device may transmit information to the source device (e.g., via an auxiliary channel) of the number of frames (or fields of delay) that exist from the time that an image enters the display device to the time when it is actually displayed. For example, this delay may be expressed as X frames. When the user commands the source device to pause, according aspects of the invention the source device transmits a command to the display device to freeze the image, and the display device freezes the image currently being displayed but nevertheless accepts X new frames into its processing buffer. The source device then transmits X new frames and then pauses the input image. When the user presses "play" again, the source device may send a play command to the display device, and start transmitting new updated frames. Upon receiving the play command, the display device unfreezes the image being displayed and updates it with the next image already in its processing pipeline, and also accepts the new updated frames into its processing chain. As a result, the user experiences an instantaneous response to pause and play commands despite the processing services/stages provided by the display device.

A computer system may be employed to implement aspects of the invention. Such a computer system is only an example of a graphics system in which aspects of the present invention may be implemented. The computer system comprises central processing units ("CPUs"), random access memory ("RAM"), read only memory ("ROM"), one or more peripherals, graphics controller, primary storage devices, and digital display device. As is well known in the art, ROM acts to transfer data and instructions to the CPUs, while RAM is typically used to transfer data and instructions in a bi-directional manner. The CPUs may generally include any number of processors. Both primary storage devices may include any suitable computer-readable media. A secondary storage medium, which is typically a mass memory device, may also be coupled bi-directionally to the CPUs, and provides additional data storage capacity. The mass memory device may comprise a computer-readable medium that may be used to store programs including computer code, data, and the like. Typically, the mass memory device may be a storage medium such as a hard disk or a tape which is generally slower than primary storage devices. The mass memory storage device may take the form of a magnetic or paper tape reader or some other well-known device. It will be appreciated that the information retained within the mass memory device, may, in appropriate cases, be incorporated in standard fashion as part of RAM as virtual memory.

The CPUs may also be coupled to one or more input/output devices, that may include, but are not limited to, devices such as video monitors, track balls, mice, keyboards, microphones, touch-sensitive displays, transducer card readers, magnetic or paper tape readers, tablets, styluses, voice or handwriting recognizers, or other well-known input devices such as, of course, other computers. Finally, the CPUs optionally may be coupled to a computer or telecommunications network, e.g., an Internet network or an intranet network, using a network connection. With such a network connection, it is contemplated that the CPUs might receive information from the network, or might output information to the network in the course of performing the above-described method steps. Such information, which is often represented as a sequence of instructions to be executed using CPUs, may be received from and outputted to the network, for example, in the form of a computer data signal embodied in a carrier wave. The above-described devices and materials will be familiar to those of skill in the computer hardware and software arts.

A graphics controller generates analog image data and a corresponding reference signal, and provides both to a digital display unit. The analog image data can be generated, for example, based on pixel data received from a CPU or from an external encoder. In one embodiment, the analog image data may be provided in RGB format and the reference signal includes the VSYNC and HSYNC signals well known in the art. However, it should be understood that the present invention may be implemented with analog image, data and/or reference signals in other formats. For example, analog image data may include video signal data also with a corresponding time reference signal.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. Indeed, there are alterations, permutations, and equivalents that fall within the scope of this invention. It should also be noted that there are many alternative ways of implementing both the process and apparatus of the present invention. It is therefore intended that the invention be interpreted as including all such alterations, permutations, and equivalents as fall within the true spirit and scope of the present invention.

What is claimed is:

1. A method for controlling latency in a display device, comprising:

transmitting audiovisual data from a source device to said display device via a first communication link; and transmitting a latency reduction signal from said source device to said display device, wherein said latency reduction signal identifies one or more processing stages to be performed in said display device based on information received at said source device from said display device relating to a plurality of processing stages available in said display device, said one or more processing stages selected by said source device to achieve a desired degree of latency reduction.

2. The method of claim 1, wherein said latency reduction signal comprises a data packet transmitted to said display device via said first communication link.

3. The method of claim 1, wherein said latency reduction signal comprises a data packet transmitted to said display device via a second communication link.

4. An apparatus for controlling latency in display device, comprising:

means for transmitting audiovisual data from a source device to a display device via a first communication link; and means for transmitting a delay optimization signal from said source device to said display device, wherein said delay optimization signal identifies one or more processing stages to be performed in said display device based on information received at said source device from said display device relating to a plurality of processing stages available in said display device, said one or more processing stages selected by said source device to achieve a desired degree of latency reduction.

5. The apparatus of claim 4, wherein said delay optimization signal comprises a data packet transmitted to said display device via said first communication link.

6. The apparatus of claim 4, wherein said delay optimization signal comprises a data packet transmitted to said display device via a second communication link.

7. A display device, comprising:

an input port for receiving audiovisual data and a time-optimization signal from a source device;

a time-optimized path for processing said audiovisual data;

a second path for processing said audiovisual data; and switching logic responsive to said time-optimization signal for determining whether said audiovisual data is processed by said time-optimized path, wherein said time-optimized path bypasses at least one processing stage performed by said second path, said at least one processing stage identified in said time-optimization signal based on information provided by said display device to said source device, said information relating to a plurality of processing stages available in said display device, said at least one processing stage selected by said source device to achieve a desired degree of time optimization.

8. The apparatus of claim 7, wherein said delay optimization signal comprises a data packet received by said display device via a first communication link, and wherein said audiovisual data is received by said display device via said first communication link.

9. The apparatus of claim 7, wherein said delay optimization signal comprises a data packet received by said display device via a first communication link, and wherein said audiovisual data is received by said display device via a second communication link.

10. A method for controlling latency in a display device, comprising:

in a source device, receiving information from a display device, said information relating to a plurality of processing stages available in said display device;

transmitting audiovisual data from the source device to said display device via a first communication link; and transmitting a processing stage-optimization signal from the source device to said display device, wherein said processing stage optimization signal identifies one or more processing stages to be bypassed in said display device when processing said audiovisual data in a latency reduction path through said display device, said one or more processing stages selected by said source device to achieve a desired degree of latency reduction.

11. The method of claim 10, wherein said processing stage optimization signal is responsive to said information received from said display device.

12. The method of claim 10, wherein said processing stage optimization signal comprises a data packet transmitted to said display device via said first communication link.

13. The method of claim 11, wherein said processing stage optimization signal comprises a data packet transmitted to said display device via said first communication link.

14. The method of claim 10, wherein said processing stage optimization signal comprises a data packet transmitted to said display device via a second communication link.

15. The method of claim 11, wherein said processing stage optimization signal comprises a data packet transmitted to said display device via a second communication link.

16. An apparatus for controlling latency in a display device, comprising:

means for receiving in a source device information from a display device, said information relating to a plurality of processing stages available in said display device;

means for transmitting audiovisual data from said source device to said display device via a first communication link; and means for transmitting a processing stage optimization signal from said source device to said display device, wherein said processing stage optimization signal identifies one or more processing stages to be bypassed in said display device when processing said audiovisual data in a latency reduction path through said display device, said one or more processing stages selected by said source device to achieve a desired degree of latency reduction.

17. The apparatus of claim 16, wherein said processing stage optimization signal is responsive to said processing stage availability data.

18. The apparatus of claim 16, wherein said processing stage optimization signal comprises a data packet transmitted to said display device via said first communication link.

19. The apparatus of claim 17, wherein said processing stage optimization signal is responsive to said processing stage availability data.

20. The apparatus of claim 16, wherein said processing stage optimization signal comprises a data packet transmitted to said display device via a second communication link.

21. The apparatus of claim 17, wherein said processing stage optimization signal comprises a data packet transmitted to said display device via a second communication link.

22. The method of claim 1, wherein said time optimization signal is responsive to a query received from said display device.

23. The method of claim 1, wherein said first communication link comprises a main link in a multi-stream digital interface between a first display source and said display device.

24. A computer program product stored on a non-transitory computer-readable storage medium for controlling latency in a display device, said computer-readable storage medium comprising:

instructions for transmitting audiovisual data from a source device to a display device via a first communication link; and instructions for transmitting a delay optimization signal from the source device to said display device, wherein said delay optimization signal identifies one or more processing states to be performed in said display device based on information received from said display device relating to a plurality of processing stages available in said display device, said one or more processing stages selected by said source device to achieve a desired degree of latency reduction.

25. A method for controlling latency in a display device, comprising:

receiving a first audiovisual data stream via a first communication link;

displaying the first audiovisual data stream as a display data stream;

determining a time lag between receiving said first audiovisual data stream and displaying said first audiovisual data stream as said display stream;

freezing said display stream in response to an interrupt signal for an interrupt period such that the initiation of said freezing is substantially contemporaneous with said video interrupt signal;

buffering a portion of said audiovisual data stream during the interrupt period; and reinitiating said display stream from where the display stream was frozen and further receiving the first audiovisual data stream including the buffered portion of the first audiovisual data stream.

26. The method recited in claim 25, wherein, said determining the time lag determines a number of frames of delay between the first audiovisual data stream and the display stream; and said buffering of the first audiovisual data stream comprises a buffering portion of the first audiovisual data stream equal to said number of frames of delay.

27. The method recited in claim 25 wherein, said substantially contemporaneous freezing of the display stream in response to the interrupt signal comprises freezing the display stream such that there is no user detectable time lag between the initiation of the interrupt signal and the freezing of the display stream.

28. The method recited in claim 25, wherein the interrupt signal comprises a user initiated pause.

* * * * *

UNITED STATES PATENT AND TRADEMARK OFFICE

CERTIFICATE OF CORRECTION

PATENT NO. : 8,766,955 B2
APPLICATION NO. : 11/828212
DATED : July 1, 2014
INVENTOR(S) : Loveridge et al.

It is certified that error appears in the above-identified patent and that said Letters Patent is hereby corrected as shown below:

Title Page: Item (73)

Under Assignee name and city/state, please change to the following:

Genesis Microchip Inc. Santa Clara, California

Signed and Sealed this
Twenty-first Day of October, 2014

Michelle K. Lee

Michelle K. Lee
*Deputy Director of the United States Patent and Trademark Office*